United States Patent [19]

Grumer et al.

[11] 4,414,253

[45] Nov. 8, 1983

[54] METHOD FOR APPLYING LIQUID PLASTICIZER TO FILAMENTARY FILTER MATERIAL

[75] Inventors: Peter Grumer, Tespe; Wolfgang Wiese, Hamwarde; Günter Serrin, Buchholz, all of Fed. Rep. of Germany

[73] Assignee: Hauni-Werke Körber & Co. KG, Hamburg, Fed. Rep. of Germany

[21] Appl. No.: 425,472

[22] Filed: Sep. 28, 1982

Related U.S. Application Data

[62] Division of Ser. No. 269,976, Jun. 3, 1981, Pat. No. 4,368,688.

[30] Foreign Application Priority Data

Jun. 20, 1980 [DE] Fed. Rep. of Germany ..... 3023001

[51] Int. Cl.[3] ..... A24D 3/00

[52] U.S. Cl. ..... 427/424

[58] Field of Search ..... 427/424; 118/674, 696, 118/325, 326, DIG. 16; 156/187, 229, 461, 495

[56] References Cited

U.S. PATENT DOCUMENTS

| | | | |
|---|---|---|---|
| 3,402,695 | 9/1968 | Baker et al. | 118/674 |
| 3,971,695 | 7/1976 | Block | 156/229 |
| 4,132,189 | 1/1979 | Greue et al. | 118/674 |

*Primary Examiner*—Sam Silverberg

*Attorney, Agent, or Firm*—Kontler, Grimes & Battersby

[57] ABSTRACT

A filter rod making machine wherein a rotary brush which is installed in a housing normally atomizes successive increments of a stream of liquid plasticizer which is supplied thereto by a varibale-delivery pump at a rate matching the speed of transport of a permeable tow of filamentary filter material through the housing so that the housing confines a quantity of residual plasticizer and the tow thereafter continuously withdraws atomized plasticizer from the housing at the rate at which the pump supplies liquid plasticizer into the range of the brush. When the tow is arrested, at least some of the residul plasticizer is evacuated from the housing and, on renewed starting of the prime mover which drives the tow, the plasticizer is admitted at a rate higher than normal rate, either by resorting to a separate pump or by gathering the evacuted residual plasticizer during the interval of idleness of the prime mover and readmitting the gathered residual plasticizer into the housing during acceleration of the tow to normal speed so as to rapidly reestablish the quantity of residual plasticizer which is necessary to ensure that a state of internal equilibrium prevails in the housing, namely, that the rate of admission of liquid plasticizer into the range of the brush again equals the rate at which the running tow removes atomized plasticizer from the housing.

7 Claims, 3 Drawing Figures

METHOD FOR APPLYING LIQUID PLASTICIZER TO FILAMENTARY FILTER MATERIAL

This application is a division of application Ser. No. 269,976, filed June 3, 1981, now U.S. Pat. No. 4,368,688.

BACKGROUND OF THE INVENTION

The present invention relates to a method of treating a tow of filamentary filter material, especially a tow which is about to be converted into the filler of a filter rod adapted to be subdivided into filter rod sections of desired length. Such filter rod sections are used in filter tipping machines for the mass production of filter cigarettes, cigars or cigarillos.

It is well known to apply a liquid plasticizing agent, such as triacetin and hereinafter called plasticizer, to a running tow of filamentary filter material. The plasticizer is atomized so that it forms a myraid of minute droplets which are propelled against the running tow and cause portions of neighboring filaments to become soft and adhere to each other so that the filaments of the filler form a maze of passages for the flow of tobacco smoke into the mouth. As a rule, the tow is first converted into a relatively wide but thin layer wherein all or nearly all of the filaments are exposed during application of plasticizer (note the commonly owned U.S. Pat. No. 3,971,695 granted July 27, 1976 to Block); this ensures more uniform distribution of droplets of plasticizer on the filaments of the tow. The thin layer of filamentary material is at least slightly permeable to liquids, i.e., a certain percentage of minute droplets of plasticizer penetrates through the interstices or gaps between neighboring filaments of the tow and must be gathered for renewed use or for delivery to a location where the thus gathered liquid does not interfere with the application of atomized plasticizer to freshly arriving increments of the running tow. In most instances, the liquid plasticizer is atomized and applied to the running tow at a predetermined rate, namely, in such a way that the quantity of liquid plasticizer which is applied to successive unit lengths of the running tow remains unchanged even if the speed of the tow is increased or reduced. This can be readily accomplished by utilizing a pump which supplies plasticizer to the plasticizer-atomizing and plasticizer-applying station at a speed which changes proportionally with variations in velocity of the running tow. The latter is withdrawn from a bale and is caused to pass along, through or past and beyond one or more so-called banding devices which facilitate conversion of the tow into a layer whose filaments are adjacent to each other and are adequately exposed for proper application of atomized plasticizer. The tow is thereupon gathered into a rod-like filler which is draped into a web of cigarette paper or the like to form therewith a continuous filter rod. The rod is severed at regular intervals to yield filter rod sections of desired length, and such sections are ready to enter the magazine of a filter tipping machine, the storage or a reservoir system wherein the curing of plasticizer is completed and which discharges filter rod sections at a rate at which the sections are processed in one or more associated filter tipping machines.

The filaments of the tow often consist of cellulose, and the plasticizer is selected with a view to soften the contacted portions of such filaments and to cause the softened portions to adhere to each other. This leads to formation of the aforementioned maze of minute passages or paths for the flow of tobacco smoke into the mouth. Many smokers are quite particular as regards the so-called draw of a filter cigarette or another smokers' product having a filter plug at one end thereof. Excessive resistance to the flow of smoke is not desirable because each drag entails the exercise of a substantial effort and the smoker fails to draw sufficient quantities of smoke into his or her mouth. On the other hand, insufficient resistance to the flow of smoke is equally (or perhaps even more) unsatisfactory because the quantity or inhaled smoke is excessive and/or because the smoke is too hot and the filter fails to remove or intercept a requisite percentage of nicotine, condensate and/or other deleterious or presumably deleterious ingredients.

Predictable resistance to the flow of tobacco smoke through a filter involves the application of liquid plasticizer in accurately metered quantities. Such predictable (and evidently acceptable or optimum) resistance is desirable and advantageous on the the additional ground that it is least likely to interfere with proper operation of apparatus, mechanisms and/or machines for further treatment of filter plugs. Thus, filter plugs of excessive hardness would be likely to damage (e.g., puncture) the uniting band material which is used to connect filter plugs with rod-shaped tobacco-containing articles, such as plain cigarettes of unit length or multiple unit length. Excessive application of plasticizer (i.e., the application of excessive quantities of plasticizer per unit length of the two) is undesirable on still another ground, namely, because the plasticizer is expensive and excessive application results in waste of such material as well as in excessive number of rejects, i.e., of finished filter rod sections which are not acceptable for further processing in a filter tipping or like machine.

It is well known to confine the station where the atomized plasticizer is applied to successive increments of the running tow in a housing designed to gather the plasticizer which has penetrated through the interstices between the filaments of the running tow. The droplets of plasticizer which have penetrated through the tow are caused to impinge upon the internal surface of the housing, and such internal surface is configured to direct the gathered liquid into the range of one or more atomizing instrumentalities, e.g., rotary brushes whose bristles convert the liquid into minute droplets while simultaneously propelling the droplets against one or both sides of the running tow. The just described mode of gathering or intercepting atomized plasticizer which has penetrated through or across the running tow is quite satisfactory when the machine for making filter rod sections operates normally, i.e., when the tow is driven at a normal or average speed, when the plasticizer is delivered at a rate which is proportional to the speed of lengthwise movement of the tow, and when the nature of the tow is such that the latter can accept optimum quantities of finely atomized plasticizer. The preferably smooth internal surface of the housing can direct the surplus of plasticizer (and more accurately the plasticizer which has penetrated through the running tow) into the range of a rotary brush in the lower portion of the housing, and such liquid plasticizer returns or flows into the lower portion of the housing by trickling along walls which flank one or both sides of the path for lengthwise movement of the running tow through the housing. After elapse of a certain interval following starting of the machine, the machine establishes in the housing a so-called internal equilibrium which simply means that the quantity of admitted plasticizer machines or very closely approximates that quantity of atomized plasticizer which is evacuated by successive increments of the running tow. The internal equilibrium can be established (or its establishment promoted) by varying the rate of delivery of plasticizer to the atomizing station while the tow is transported at a constant speed.

A drawback of presently known methods and apparatus for applying liquid plasticizer is that the aforediscussed internal equilibrium is invariably destroyed when the filter rod making machine is arrested, and also that it takes a relatively long interval of time to reestablish such equilibrium after renewed starting of one or more prime movers which drive the rotary and/or otherwise movable constituents of the machine. The internal equilibrium is also destroyed or rendered unsatisfactory if the feed of one of two constituents (filter tow and plasticizer) to the atomizing station is changed while the rate of delivery of the other constituent remains unchanged. Since a modern high-speed filter rod making machine turns out very large quantities of rod-shaped articles per unit of time, and since the filter rod sections which contain unsatisfactory quantities of plasticizer must be segregated because they would contribute to the making of unsatisfactory smokers' products, it is evidently desirable to reduce the period of absence of the internal equilibrium to a minimum.

OBJECTS AND SUMMARY OF THE INVENTION

An object of the invention is to provide a novel and improved method of applying atomized plasticizer to a running tow of filamentary filter material in such a way that the periods of improper application of plasticizer are reduced to a fraction of the time which elapses when the application of plasticizer takes place in accordance with conventional methods.

Another object of the invention is to provide a novel and improved method of applying liquid plasticizer to a running tow of filamentary filter material immediately after the tow is set in motion.

A further object of the invention is to provide a method which reduces the likelihood of excessive wetting of a running tow of filamentary filter material while the tow is in the process of acceleration to its normal speed.

An additional object of the invention is to provide a method of the above outlined character which reduces the likelihood of breakage or tearing of a filamentary filter material during certain stages of operation of the machine wherein the tow is converted into the filler of a filter rod.

Still another object of the invention is to provide a method of the above outlined character which reduces the likelihood of excessive hardening of filter rod sections produced immediately after initial or renewed starting of the machine which turns out filter rod sections for the making of filter tipped smokers' products.

One feature of the invention resides in the provision of a method of applying liquid plasticizer (e.g., triacetin) to a foraminous running tow of filamentary filter material (such as cellulose acetate fibers). The method comprises the steps of establishing and maintaining a treating zone, conveying a tow into, through and beyond the treating zone at a variable speed (one of the several speeds at which the tow is or can be conveyed is zero), conveying into the treating zone atomized liquid plasticizer at a first rate such that successive increments of the tow which leave the treating zone entrain the admitted plasticizer as soon as the treating zone accumulates a quantity of residual plasticizer (e.g., in the form of droplets which are suspended in air in the region of the treating zone and/or which accumulate and flow along the internal surface of a housing or casing which is preferably provided to confine the treating zone, some of the residual plasticizer forming part of liquid which has penetrated through the interstices of the foraminous tow), interrupting the conveying of the tow and/or the conveying of the plasticizer (e.g., in response to the generation of a defect signal which is indicative of unsatisfactory rate of conveying of liquid plasticizer, unsatisfactory conveying of the tow toward, through or beyond the treating zone, unsatisfactory characteristics of the product which embodies the treated tow, and/or a combination of such factors), withdrawing at least some residual plasticizer from the treating zone on interruption of conveying of the tow and/or plasticizer resuming the conveying steps (e.g., after the cause of malfunction which has initiated the generation of a defect signal has been eliminated) including resuming the conveying of liquid plasticizer but at a higher second rate as to restore the quantity of residual plasticizer in the treating zone, and thereupon again proceeding with the conveying of liquid plasticizer at the first rate (i.e., at a rate such that the quantity of residual plasticizer which dwells in the treating zone remains substantially unchanged because the running tow removes from the treating zone a given quantity per unit of time or unit length of the tow, namely, a quantity which matches the quantity of liquid plasticizer that is admitted into the treating zone during the same interval of time or per unit length of the running tow).

The method preferably further comprises the step of establishing and maintaining a main source of supply of liquid plasticizer (e.g., in a suitable vessel whose contents are preferably agitated in order to enhance the homogeneousness of liquid which is being drawn from such source). The plasticizer conveying step then includes drawing plasticizer from the main source (e.g., by resorting to a variable-delivery pump, such as a gear pump), and the withdrawing step then preferably includes accumulating the withdrawn portion of residual plasticizer independently of the main source. The step of resuming the conveying of plasticizer then preferably includes admitting the plasticizer from the main source at the first rate as well as simultaneously reintroducing the withdrawn portion of residual plasticizer into the treating zone. The just mentioned accumulating step preferably includes causing at least some residual plasticizer to leave the treating zone by gravity flow or under the action of suction.

The plasticizer conveying step preferably includes supplying to the treating zone at least one continuous stream of liquid plasticizer and atomizing successive increments of the stream on entry into the treating zone.

The step of establishing and maintaining the treating zone may comprise confining the treating zone in a housing which defines an elongated path for the transport of the tow therethrough, and the plasticizer conveying step then comprises spraying atomized plasticizer against one side of the tow in the aforementioned path whereby at least some of the plasticizer penetrates through the foraminous tow and the plasticizer which has penetrated through the tow forms part of residual plasticizer in the treating zone. The withdrawing step then comprises (or such withdrawing step may comprise) allowing residual plasticizer to flow along the interior of the housing and to issue from the housing by gravity flow. The method then preferably further comprises the step of storing the issuing plasticizer in the proximity of the treating zone during interruption of transport of the tow along the aforementioned path (for example, the issuing plasticizer can be stored in the chamber of a container whose bottom constitutes a membrane which is displaceable in a direction to return the accumulated residual plasticizer into the treating zone during the initial stage of renewed conveying of the tow through the housing, namely, during that stage which normally involves acceleration of the tow from a lower speed (e.g., zero speed) to the normal or average speed). In fact, the readmission of withdrawn residual plasticizer can be completed with a fraction of the interval which is needed to accelerate the tow from zero speed to the normal or average speed.

The novel features which are considered as characteristic of the invention are set forth in particular in the appended claims. The apparatus itself, however, both as to its construction and its mode of operation, together with additional features and advantages of the method, will be best understood upon perusal of the following detailed description of certain specific embodiments with reference to the accompanying drawing.

DESCRIPTION OF THE PREFERRED EMBODIMENTS

Figures 1, 2, 3:
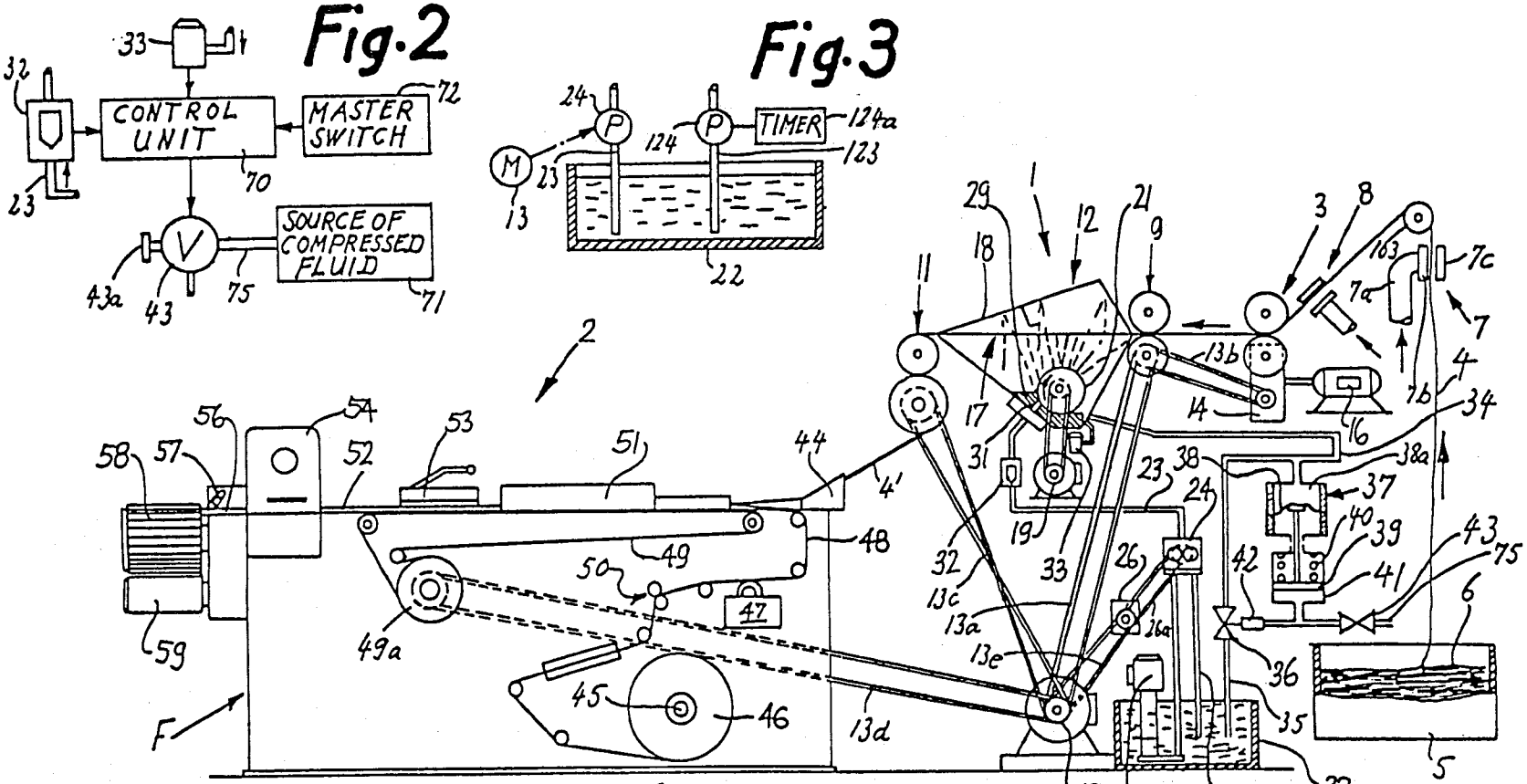
FIG. 1 is a schematic partly elevational and partly sectional view of an apparatus which can be used for the practice of the novel method and is incorporated in a filter rod making machine.
FIG. 2 is a diagrammatic view of a detail in the apparatus of FIG. 1.
FIG. 3 illustrates a portion of a modified apparatus.

Referring first to FIG. 1, there is shown a filter rod making machine which is designed to produce a file of discrete filter rod sections 56 of desired length, e.g., of six or eight time sunit length. The machine comprises a first section or unit 1 which serves to prepare a continuous tow 4 of filamentary filter material for draping into a continuous web 48 of cigarette paper, imitation cork or other suitable wrapping material. The tow 4 is stored in the form of a bale 6 which is confined in a receptacle 5 and stores a substantial supply of compacted filamentary filter material. The means for withdrawing tow 4 from the bale 6 comprises a first pair of advancing rolls 3 which cause the tow to travel over a deflecting roller 103 and past two so-called banding devices 7 and 8 respectively located upstream and downstream of the roller 103. The banding devices comprise pipes (see the pipe *7a*) which are connected to a source of compressed gaseous fluid (e.g., air), nozzles (see the nozzle *7b*) whose orifices direct a plurality of small streams of compressed gaseous fluid against successive increments of the moving tow whereby the streams penetrate through the tow and rebound upon suitable plates (see the plate *7c*). The purpose of the banding devices 7 and 8 is to loosen the tow 4 so that the latter can be converted into a thin but wide layer whose filaments are adjacent to each other and are exposed for satisfactory contact with finely atomized liquid plasticizer, such as triacetin.

The banded tow 4 is thereupon caused to enter the nip of two additional advancing rolls 9 whose peripheral speed preferably exceeds the peripheral speed of the first advancing rolls 3 so that the filaments of the tow are stretched during travel between the rolls 3 and 9. This renders it possible to reduce the customary crimp of the filamentary filter material, e.g., to stretch the filaments to their elastic limit and to thereby ensure that all of the filaments (or practically all of the filaments) are straight during transport toward and through a plasticizer applying station 12 which is disposed between the advancing rolls 9 and a third pair of advancing rolls 11.

The tow 4' which advances beyond the nip of the advancing rolls 11 is converted into a cylindrical filler during travel through a gathering horn 44 forming part of a second section or unit 2 of the filter rod making machine shown in FIG. 1. The second section or unit 2 comprises a frame F which supports a spindle 45 for a reel 46 of wrapping material. The web 48 is drawn off the reel 46 by a pair of advancing rolls 50, and one side of the running web is coated with adhesive by a paster 47 which is installed upstream of a wrapping mechanism 51 disposed above an endless transporting belt conveyor 49 known as garniture. The conveyor 49 cooperates with the mechanism 51 to drape successive increments of the web 48 around successive increments of the filler issuing from the gathering horn 44 so that the web 48 is converted into a tubular envelope whose marginal portions overlap each other to form a seam which extends in the longitudinal direction of the resulting continuous filter rod 52. The seam is heated or cooled (depending on the nature of adhesive which is applied by the paster 47) by a sealer 53 and the rod 52 thereupon enters a cutoff 54 which severs it at regular intervals so that the rod yields a single file of discrete filter rod sections 56 of desired length. Successive filter rod sections 56 are accelerated by a rotary cam 57 which propels the sections 56 into successive axially parallel peripheral flutes of a rotary drum-shaped row-forming conveyor 58 serving to convert the single file of sections 56 into one or more rows wherein the sections travel sideways. The row or rows of filter rod sectins 56 are deposited on the upper reach of a belt conveyor 59 which delivers the filter rod sections into storage, into a reservoir system (such as that known as Resy and manufactured by the assignee of the present application) or directly into the magazine of a filter tipping machine for cigarettes or other rod-shaped smokers' products. A filter tipping machine of the type known as MAX S and capable of processing the filter rod sections 56 is manufactured by the assignee of the present application.

Referring again to the first section or unit 1 of the machine shown in FIG. 1, the lower rolls of the three pairs of advancing rolls 3, 9 and 11 receive torque from the main prime mover 13 (e.g., a variable-speed electric motor) of the filter rod making machine. The output element of the main prime mover 13 drives a first endless belt of chain **13*a* which rotates the lower roll of the pair of rolls 9 and which further drives a second endless belt or chain 13*b* serving to rotate the input element of a variable-speed transmission 14 whose output element drives the lower roll 3. The ratio of the transmission 14 can be changed by a servomotor 16, e.g., in response to signals which are generated by the operator or in response to signals from one or more devices which monitor the condition of the filter rod 52 and/or the condition of filter rod sections 56 in a manner not forming part of the present invention. As mentioned above, the peripheral speed of the rolls 3 is less than that of the rolls 9 so that the filaments of the tow 4 are stretched during travel from the nip of the rolls 3 toward the nip of the rolls 9**.

A third endless belt or chain 13*c* drives the lower advancing roll 11, and a further endless chain or belt 13*d* transmits motion to a pulley 49*a* for the garniture 49. The manner in which the advancing rolls 50 for the web 48 are driven is not specifically shown in the drawing.

The plasticizer conveying and applying mechanism at the station 12 comprises a housing 18 having a slot-like inlet immediately or closely downstream of the nip of the advancing rolls 9 and a similar outlet immediately or closely upstream of the apex of the upper advancing roll 11. Such slot-like inlets and outlets are shown in greater detail in the commonly owned copending application Ser. No. 143,184 filed Apr. 24, 1980 by Heinz Greve et al. The horizontal path along which the flattened and stretched tow 4 advances through the housing 18 is denoted by the reference character 17. The housing 18 contains an atomizing device in the form of a brush 21 drive by a discrete prime mover 19, e.g., a constant-speed electric motor. The bristles of the rapidly rotating brush 21 propel minute droplets of liquid plasticizer against the underside of the tow 4 which advances along the path 17 whereby some droplets adhere to the tow and the remaining droplets penetrate through the interstices or gaps between the filaments of the tow and enter the upper portion of the housing 18 above the path 17. Such droplets deposit on the internal surface of the upper portion of the housing 18 and trickle or flow downwardly into the lower portion below the path 17 for renewed atomizing and propulsion against the running tow.

A supply of liquid pasticizer (e.g., triacetin) is stored in a main source here shown as a vessel 22. A continuous stream of plasticizer is drawn from the vessel 22 by a pump 24 (e.g., a gear pump which can be said to constitute a means for conveying to the housing 18 metered quantities of liquid plasticizer per unit length of the tow 4) which is installed in a conduit 23. The rotary parts of the pump 24 are driven by the output element of the main prime mover 13 by way of a further belt or chain 13*e* which drives the input element of a variable-speed transmission 26. The output element of the transmission 26 drives the pump 24 by way of a belt or chain 26*a*. A second pump 27 in the vessel 22 serves to agitate and circulate the supply of liquid plasticizer and to thus ensure that the intake end of the conduit 23 invariably receives such quantities of plasticizer as are required in the housing 18 in view of the momentary speed of the prime mover 13. Since the prime mover 13 drives the tow 4 as well as the pump 24, the quantity of liquid plasticizer which is conveyed into the housing 18 per unit of time is always proportional to the quantity of filter material which is conveyed through the station 12 during the same unit of time. The surplus of plasticizer which is drawn from the vessel 22 via conduit 23 is returned into the vessel by a return line 28.

The housing 18 further contains means for uniformly distributing the admitted liquid plasticizer along the full length of the brush 21. Such distributing means comprises an elongated manifold 29 which is installed in the lower portion of the housing 18 and has one or more elongated channels 31 extending in parallelism with the axis of the brush 21 and receiving plasticizer from the discharge end of the conduit 23. The latter contains a suitable flow metering or monitoring device 32 which is also shown in FIG. 2.

The housing 18 further contains or is connected with a second monitoring device 33 (e.g., a hydroelectronic transducer or any known design) which ascertains the quantity of plasticizer in the lower portion of the housing 18 and generates corresponding electric signals for transmission to a control unit 70 shown in FIG. 2. The flow metering device 32 generates signals which denote whether or not the pump 24 supplies a requisite quantity of plasticizer into the manifold 29, and the monitoring device 33 generates signals denoting whether or not the lower portion of the housing 18 contains an excessive quantity of liquid plasticizer. The monitoring device 33 may also constitute a pressure-responsive switch which simply closes when the static pressure of residual plasticizer which accumulates in the lower portion of the housing 18 exceeds a permissible value, namely, a value which indicates that the rate of conveying of plasticizer into the housing 18 is too high and/or that the tow 4 cannot accept requisite quantities of plasticizer per unit length of its filamentary material. The monitoring device 33 can also be said to detect the quality of the atomizing action of bristles on the core of the rotating brush 21. If the motor 19 is arrested or does not drive the brush 21 at a satisfactory speed, the quantity of residual plasticizer in the housing 18 will increase and the device 33 will transmit an appropriate signal to effect a correction or to stop the main prime mover 13.

In accordance with a feature of the present invention, the housing 18 is further connected with an evacuating pipe or conduit 34 whose left-hand end communicates with the lower portion of the housing and whose discharge end is connected to a chamber 38*a* at a level about a deformable membrane 38 in a container or reservoir 37 serving to store a predetermined quantity of liquid plasticizer in response to stoppage of the prime movers 13 and 19. The conduit 34 is further connected with or comprises a branch line 34 containing a shutoff valve 36 and discharging into the vessel 22 for the main supply of liquid plasticizer.

The membrane 38 is normally held in a lower end or retracted position by a resilient element such as a coil spring 40 acting upon the piston 39 of a single-acting pneumatic cylinder 41. A similar cylinder 42 is or can be provided to actuate the shutoff valve 36. The cylinders 41 and 42 can receive compressed air or another suitable gaseous fluid by way of a conduit 75 containing a shutoff valve 43. The source of compressed gas for admission into the conduit 75 when the valve 43 is open is shown in FIG. 2, as at 71. FIG. 2 also shows a master switch 72 which can be manipulated by hand or by remote control to arrest the prime movers 13, 19 and to simultaneously transmit a signal to the control unit 70 instead of or in addition to a signal from the monitoring device 32 and/or 33.

The operation is as follows:

When the machine is in use, the prime mover 13 drives the pairs of advancing rolls 3, 9, 11, the pump 24 (by way of the variable-speed transmission 26) and the moving parts of the section or unit 2 (the cutoff 54 is or may be provided with a discrete motor) whereby the rolls 3 draw the tow 4 from the bale 6 and such tow is loosened during travel past the banding devices 7, 8 prior to being stretched during travel between the rolls 9 and 11. The bristles of the rotating brush 21 propel droplets of atomized plasticizer against the tow 4 during travel through the housing 18, and the quantity of plasticizer which is sprayed onto successive unit lengths of the tow 4 is uniform because the prime mover 13 drives not only the rolls 3, 9 and 11 but also the pump 24. In other words, when the speed of the prime mover 13 (and hence the speed of lengthwise movement of the running tow 4) increases, the rate at which the pump 24 supplies liquid plasticizer to the manifold 29 also increases or vice versa. The brush 21 is driven at a constant speed and cooperates with the manifold 29 to atomize successive increments of the stream of liquid plasticizer supplied to its bristles by the channel or channels 31. Those droplets of atomized plasticizer which penetrate through the layer of filamentary material in the path 17 are intercepted by the upper portion of the housing 18 and drip or flow back into the lower portion to be thereby returned into the range of orbiting bristles of the brush 21 which bristles propel the returning liquid against the tow 4 in the path 17. After a relatively short interval of operation of the machine subsequent to starting of the prime movers 13 and 19, the mechanism at the station 12 establishes a state of equilibrium between the quantity of plasticizer which is conveyed into the housing 18 and the quantity of atomized plasticizer which is removed by the running tow 4, i.e., in normal operation the quantity of plasticizer supplied via conduit 23 per unit of time is identical with the quantity of plasticizer removed by the tow 4 from the housing 18. At such time (in normal operation), the control unit 70 maintains the shutoff valve 43 in open position so that the cylinders 41 and 42 receive compressed air from the source 71. Consequently, the branch 35 of the conduit 34 is sealed and the spring 40 in the cylinder 41 is compressed so that the membrane 38 is held in its upper end position and provides little if any room for gravity flow of a certain (predetermined) quantity of liquid plasticizer from the housing 18 into the chamber 38*a* of the cylinder 41.

If the monitoring device 32 and/or the monitoring device 33 (and/or the master switch 72 which is actuatable by the attendants) transmits a signal denoting that the rate of delivery of at least one component of the filter rod 52 (i.e., of the tow 4 and/or the web 48 and/or the plasticizer) is unsatisfactory, the control unit 70 transmits a signal which causes the valve 43 to connect the cylinders 41 and 42 with the atmosphere (via venting orifice of a nozzle 43*a*) and to simultaneously seal the two cylinders from the source 71 of compressed gaseous fluid. The spring (not shown) in the cylinder 42 then causes or allows the valve 36 to open and the spring 40 retracts the deformable piston or membrane 38 to its lower end position so that the chamber 38*a* in the upper part of the container 37 can receive and store a predetermined quantity of liquid plasticizer which flows into the lower part of the housing 18 when the brush 21 is idle. The liquid plasticizer which has penetrated through the filamentary filter material in the path 17 and has accumulated at the inner side of the upper portion of the housing 18 continues to flow toward and into the lower portion of the housing and thence into the intake end of the conduit 34. The liquid flowing in the conduit 34 fills the chamber 38*a* in the upper portion of the container 37 above the membrane 38 and the remnant of accumulated liquid plasticizer flows through the branch conduit 35, open valve 36 and back into the vessel 22. The quantity of liquid plasticizer which flows through the branch 35 and back into the vessel 22 depends on the duration of interruption, i.e., on the length of the interval during which the bristles of the brush 21 fail to propel finely dispersed droplets of liquid plasticizer against the running tow 4 in the path 17.

The evacuation of residual liquid plasticizer from the lower portion of the housing 18 in response to actuation of the valve 43 by the control unit 70 ensures that the liquid contents of the housing 18 are evacuated to the extent which is necessary to prevent soaking of the tow 4 with liquid plasticizer once the brush 21 is again set in rotary motion. Such soaking could unduly weaken the tow 4 so that the tow would break on renewed starting of the main prime mover 13 and resulting rotation of the advancing rolls 3, 9 and 11. It will be recalled that the tow 4 is stretched downstream of the rolls 3 so that the danger of breakage is quite pronounced provided that the bristles of the brush 21 are permitted to propel excessive quantities (e.g., a veritable flood) of liquid plasticizer against the oncoming increments of the tow 4 in the path 17. The atomizing action is satisfactory when the bristles of the brush 21 receive liquid plasticizer only by way of the channel or channels 31 in the manifold 20 as well as the relatively small quantities of liquid plasticizer which descend into the lower portion of the housing 18 after having penetrated across the path 17 to flow back into the lower portion by trickling along the internal surface of the housing 18 in the regions at both sides of the path 17. However, such atomizing action (if any) may be utterly unsatisfactory if the lower portion of the housing 18 can accumulate a rather large pool of residual liquid plasticizer which has trickled down the internal surface of the housing while the brush 21 was driven at less than satisfactory speed, while the conduit 23 was in the process of delivering an excessive quantity of liquid plasticizer per unit of time, while the filamentary filter material in the path 17 was incapable of accepting and entraining a desired quantity of atomized plasticizer and/or for any other reason which leads to accumulation of excessive quantities of residual plasticizer in the housing 18 while the valve 36 is closed and the capacity of the chamber 38*a* above the membrane 38 of the container 37 is small or negligible. Under such circumstances, the bristles of the brush 21 propel veritable streams or large drops of liquid plasticizer which thoroughly soaks the tow 4 in the path 17 and can lead to the aforediscussed breakage or, at the very least, to the making of unsatisfactory filter plugs. Thus, once the applied plasticizer sets, it imparts to the filter plugs a certain hardness which might be too pronounced if the respective filter plugs contain excessive quantities of plasticizer. The plasticizer softens the contacted portions of the filaments while it is still in a liquid state and causes such portions to adhere to each other so that the filaments of the filler in a finished filter rod section 56 form a maze of minute paths for the flow of tobacco smoke. If the quantity of applied plasticizer is excessive, the filler of the filter rod section 56 can constitute a solid plug which is devoid of any paths for the flow of tobacco smoke or which offers excessive resistance to such flow. The smoker is annoyed because he or she expects that the resistance to the flow of smoke will be within certain acceptable limits.

As a rule, or at least in many filter rod making machines, the filter rod sections which are produced during acceleration of the machine to normal operating speed are discarded because they are potentially or actually defective, i.e., the tension of the filamentary filter material might not be satisfactory, the ratio of plasticizer to filamentary material per unit length of the filter rod 52 may be excessive or insufficient, the condition of adhesive in the paster 47 might have changed so that the adhesive cannot properly bond the web 48 to the filler (trated and converted tow 4') and/or for other reasons. On the other hand, it is evidently desirable to ensure that the number of rejects during restarting of the machine should be as low as possible, especially in a modern high-speed filter rod making machine which can turn out many thousands of filter plugs per minute. Thus, it is desirable that the aforementioned internal equilibrium in the housing 18 be established shortly or practically immediately after starting of the prime movers 13 and 19. This is accomplished by the control unit 60 which actuates the valve 43 as soon as the motors 13 and 19 are started (the motor 19 can be started in automatic response to starting of the motor 13 or vice versa). The valve 43 then seals the nozzle 43*a* from the atmosphere and connects the chambers of the cylinders 41, 42 with the source 71 of compressed gaseous fluid. The valve 36 is closed and compressed fluid which flows into the lower portion of the cylinder 41 comprises the spring 40 via piston 39 so that the membrane 38 is moved upwardly and expels the accumulated discrete supply of liquid plasticizer into the conduit 34 and thence into the lower portion of the housing 18, i.e., into the range of the tips of bristles on the rotating brush 21. This ensures that the brush 21 atomizes the liquid plasticizer which is supplied by the pump 24 via conduit 23 and manifold 29 as well as the additional liquid plasticizer which is supplied by the membrane 38 which acts not unlike a plunger or piston and forces the stored quantity of residual liquid plasticizer to return into the lower portion of the housing 18. The marginal portion of the membrane 38 can be sealingly held between two separable (upper and lower) portions or halves of the cylinder 41. It has been found that the admission of liquid plasticizer from the container 37 into the lower portion of the housing 18 ensures the establishment of the aforementioned internal equilibrium even before the prime mover 13 completes the acceleration of advancing rolls 3, 9, 11 and certain moving parts of the unit or section 2 to their normal or average speed.

Once the internal equilibrium is established, the running tow 4 again removes all of the plasticizer which is supplied by the conduit 23 so that the quantity of plasticizer which enters the housing 18 equals the quantity of plasticizer leaving the housing with the properly sprayed tow 4. The aforedescribed operation is repeated again when the prime mover 13 and/or 19 is arrested for any one of a variety of reasons each of which is normally an indicator of improper conveying of filamentary filter material, or improper operation of the unit 2, of improper conveyor of plasticizer via conduit 23, of improper spraying action of the brush 21 or of the inability of filamentary filter material in the housing 18 to accept and retain requisite quantities of atomized plasticizer.

The properly treated tow 4' is then converted into a rod-like filler during travel through the gathering horn 44 and is draped into the web 48 to form therewith the aforementioned continuous rod 52. The rod 52 is severed by the cutoff 54 and the resulting filter rod sections 56 are propelled by the accelerating cam 57 to form one or more rows in the drum-shaped conveyor 58 which delivers the row or rows to the upper reach of the belt conveyor 59 for transport to storage or to the next processing station. The curing of plasticizer in the fillers of the filter rod sections 56 can continue during travel in the peripheral flutes of the conveyor 58, during travel with the belt conveyor 59 or even during storage in the aforementioned reservoir system (such as Resy).

It will be noted that the improved method must satisfy certain contradictory requirements, namely, rapid reestablishment of the supply or quantity of residual plasticizer in the treating zone within the housing 18 but without excessive soaking or wetting of filamentary filter material during acceleration of the tow from zero speed to normal or average speed. The solution is that, when the conveying of tow 4 through the housing 18 (i.e., along the path 17) is interrupted, at least some of the quantity of residual plasticizer in the housing 18 is removed from the treating zone by the simple expedient of providing for such residual plasticizer a storage place or container 37 in close or immediate proximity of the housing 18, and of returning the thus accumulated or withdrawn residual plasticizer into the housing 18 when the conveying of the tow by the rolls 3, 9, 11 is resumed. This means that, when the prime mover 13 is set in motion again, the treating zone in the housing 18 receives liquid plasticizer in quantities exceeding those which are removed by the treated tow 4' but less than would be the case if the residual plasticizer were retained, in its entirety, in the interior of the housing 18 on interruption of conveying of the tow 4 along the path 17. Consequently, the quantity of residual plasticizer in the housing 18 is rapidly restored to its normal value at which an internal equilibrium exists in the treating zone because the quantity of liquid plasticizer admitted via conduit 23 matches the quantity which is removed by the tow 4 on its way from the housing 18 toward the upper roll 11. Such rapid restoration of internal equilibrium takes place without risking excessive soaking or wetting of filamentary filter material with liquid plasticizer because the rate at which the contents of the container 37 are returned into the housing 18 can be regulated practically at will, the same as the quantity of residual plasticizer which is stored in the container 37 rather than being permitted to flow into the branch 35 and back into the main source of plasticizer in the vessel 22.

The improved method can be modified in a number of ways without departing from the spirit of the invention. For example, the container 37 can be omitted and the entire residual plasticizer returned into the vessel 22 as soon as the transport of the tow 4 through the housing 18 is interrupted if the pump 24 is designed or operated in such a way that the rate at which it supplies liquid plasticizer into the housing 18 increases automatically during acceleration of the tow 4, i.e., during that interval which immediately follows first starting or renewed starting of the prime mover 13. Alternatively, the apparatus could include a further pump which would be started and which would remain in operation only during a certain interval following starting of the prime mover 13. The solution which is shown in FIGS. 1 and 2 is preferred at the present time because the container 37 can accumulate an accurately metered quantity of residual plasticizer which has been evacuated from the housing 18 on interruption of transport of the tow 4, and such accurately metered quantity can be returned into the housing 18 during the initial stage of acceleration of the tow 4 on starting of the prime mover 13 following an interruption. When the prime mover 13 is started gain, the pump 24 delivers a stream of liquid plasticizer into the range of bristles of the brush 21 at the rate which is proportional to the speed of the tow 4, and the membrane 38 admits the accumulated residual plasticizer from the chamber 38*a* of the container 37 into the lowermost part of the housing 18 where the returned plasticizer is entrained and atomized by the bristles of the brush 21 to ensure that the treating zone in the housing 18 can rapidly accumulate the requisite quantity of residual plasticizer which thereupon remains therein while the pump 23 supplies liquid plasticizer via conduit 24 at the same rate at which the tow 4 withdraws atomized plasticizer from the housing 18.

If the container 37 is omitted and the apparatus of the present invention does not employ an additional pump, the pump 24 must be designed and controlled to ensure that, when the prime mover 13 is started, the conduit 23 delivers into the range of the brush 21 liquid plasticizer at a rate which is higher than the normal rate because the pump 24 then constitutes the means for admitting plasticizer that is needed for proper application to successive increments of the running tow 4 plus the plasticizer which is needed to restore the internal equilibrium, i.e., the plasticizer which is needed to accumulate in the housing 18 a predetermined quantity of residual plasticizer which remains in the housing during normal operation of the apparatus, namely, while the rate of admission of plasticizer via conduit 23 matches the rate of evacuation of plasticizer via outlet of the housing 18. The controls for a pump which would increase its output at a lower speed and reduce its output at an elevated speed of the associated motor are rather complex and expensive. Therefore, the provision of the container 37 which allows for utilization of a commercially available gear pump (i.e., a pump whose output or rate of delivery increases with increasing speed of its motor) is preferred at this time. The supply of liquid plasticizer which accumulates in the container 37 constitutes a relatively small reserve which is preferably close to the housing 18 and is available for reintroduction into the housing 18 as soon as the prime mover 13 is started. If desired, the conduit 34 can discharge into the conduit 23 so that only one of these conduits admits liquid plasticizer directly into the housing 18, i.e., into the range of bristles on the rotating brush 21. This brush can be replaced with other atomizing means, e.g., with a nozzle of the type disclosed in commonly owned U.S. Pat. No. 4,132,189 granted Jan. 2, 1979 to Heinz Greve et al.

A separate pump, which is used in addition to the pump 24 and is active only after starting of the prime mover 13, i.e., during acceleration of the tow 4 from zero speed to normal operating speed, is desirable or advantageous when the prime mover 13 is arrested for longer periods of time, e.g., for periods exceeding 60 seconds. Such additional pump is shown at 124 in FIG. 3 of the drawing; it is installed in a conduit 123 which receives liquid plasticizer from the vessel 22. The reference character 124*a* denotes a timer which is started simultaneously with starting of the prime mover 13 and causes the pump 124 to draw liquid plasticizer from the vessel 22 for a certain interval of time following starting of the prime mover 13. If the apparatus comprises the pump 124, the container 37 may but need not be omitted. If the container 37 is omitted, the conduit 34 merely serves to return all of the residual plasticizer into the vessel 22 if the interval of idleness of the prime mover 13 is sufficiently long to allow for return flow of the entire quantity of residual plasticizer. The pump 124 is adjusted to rapidly restore the requisite quantity of residual plasticizer but without permitting undue wetting of filamentary filter material during acceleration of the tow 4 to normal or average speed. The valve 36 then remains open as long as the prime mover 13 is idle.

It has been found that the improved method invariably ensures rapid restoration of internal equilibrium in the treating zone which is defined and confined by the housing 18, and that such method ensures rapid establishment of internal equilibrium without risking excessive moisturizing of filaments forming the tow 4, even during a very short portion of that interval which is required to accelerate the tow to its normal or average speed. In fact, and as already mentioned above, restoration of the internal equilibrium can be completed well ahead of completion of acceleration of the tow 4 to such normal or average speed. This is due to the fact that, even though the membrane 38 or the pump 124 causes a second stream of liquid plasticizer to enter the housing 18 immediately after starting of the prime mover 13, the rate at which such second stream is supplied can be readily regulated in such a way that the brush 21 or another suitable atomizing device is incapable of propelling excessive quantities (i.e., a flood) of liquid plasticizer against the adjacent increments of the tow 4 while the tow is transported through the housing 18 at less than normal speed because the prime mover 13 is still in the process of accelerating its output element.

Another advantage of the improved method is that the number of rejects is reduced to a bare minimum because there is no need to segregate, due to lack of quality, any filter rod sections which are produced after acceleration of the tow 4 to normal or average speed. In other words, the machine of FIG. 1 can be associated with a mechanism which automatically ejects only those filter rod sections which are produced during acceleration of the tow 4 but none of the sections which are produced when the acceleration of the tow is completed. Preferably automatic ejection or segregation of filter rod sections which are produced during acceleration stage of the tow following a period of idleness of the main prime mover of the filter rod making machine is considered advisable and necessary in order to prevent entry of unsatisfactory filter rod sections into storage, into a reservoir (curing) system, or directly into the magazine of a filter tipping machine. Such filter rod sections are normally unsatisfactory or less than entirely satisfactory because some of the adhesive which is applied by the paster 47 to the web 48 is permitted to become dry or cold (depending on the nature of adhesive) in the region between the paster 47 and the garniture 49 when the prime mover 13 is idle, because the sealer 53 is deactivated (e.g., lifted above the seam of the filter rod 52 therebelow) when the prime mover 13 is idle, because the plasticizer on the flat tow 4' has set in the zone between the rolls 11 and the gathering horn 44 prior to conversion into a rod-like filler, and/or for other reasons. In other words, the plasticizer applying apparatus of the present invention does not contribute to the number of rejects because all of the rejects are caused by phenomena or factors other than the presence of residual plasticizer in the housing 18 in normal operation of the machine and/or the need to prevent excessive wetting of filamentary filter material or renewed starting of the prime mover.

The container 37 will be retained and used even if the apparatus employs the second pump 124 if neither the pump 124 nor the container (when used alone) can guarantee rapid restoration or establishment of a state of equilibrium in the housing 18 after renewed or initial starting of the prime mover 13.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of applying liquid plasticizer to a foraminous running tow of filamentary filter material, comprising the steps of establishing and maintaining a treating zone; conveying the tow into, through and from said zone at a variable speed; conveying into said zone atomized liquid plasticizer at a first rate such that successive increments of the tow which leave said zone entrain the admitted plasticizer as soon as said zone accumulates a quantity of residual plasticizer; interrupting at least one of said conveying steps; withdrawing at least some residual plasticizer from said zone on interruption of said one conveying step; resuming said one conveying step; conveying the plasticizer at a higher second rate on resumption of said one conveying step so as to restore said quantity of residual plasticizer; and thereupon again proceeding with conveying of plasticizer at said first rate.

2. The method of claim 1, further comprising the steps of establishing and maintaining a main source of supply of liquid plasticizer, said plasticizer conveying step including drawing plasticizer from said source and said withdrawing step including accumulating the withdrawn portion of residual plasticizer independently of the main source, said step of conveying the plasticizer at said second rate including admitting the plasticizer from the main source at said first rate as well as reintroducing the withdrawn portion of residual plasticizer into said zone.

3. The method of claim 2, wherein said accumulating step includes causing at least some residual plasticizer to leave said treating zone by gravity.

4. The method of claim 1, wherein said plasticizer conveying step includes supplying to said zone at least one continuous stream of liquid plasticizer and atomizing successive increments of the stream on entry into said zone.

5. The method of claim 1, wherein said step of establishing and maintaining said treating zone comprises confining such zone in a housing which defines an elongated path for transport of the tow therethrough, said plasticizer conveying step including spraying atomized plasticizer against one side of the tow in said path whereby at least some of the plasticizer penetrates through the tow and the plasticizer which has penetrated through the tow forms part of said residual plasticizer.

6. The method of claim 5, wherein said withdrawing step includes allowing residual plasticizer to flow along the interior of the housing and to issue from the housing by gravity flow.

7. The method of claim 6, further comprising the step of storing the issuing plasticizer in the proximity of said zone during interruption of transport of the tow along said path.

* * * * *